US005676602A

United States Patent [19]

Katz et al.

[11] Patent Number: 5,676,602

[45] Date of Patent: *Oct. 14, 1997

[54] TOY WATER SLIDE

[75] Inventors: Harvey Katz, Barrington; Marvin Smollar, Libertyville, both of Ill.

[73] Assignee: Empire Industries, Inc., Delray Beach, Fla.

[ * ] Notice: The term of this patent shall not extend beyond the expiration date of Pat. No. 5,551,922.

[21] Appl. No.: 655,844

[22] Filed: May 31, 1996

Related U.S. Application Data

[63] Continuation of Ser. No. 250,565, May 27, 1994, Pat. No. 5,551,922.

[51] Int. Cl.[6] ..... A63G 21/18

[52] U.S. Cl. ..... 472/117

[58] Field of Search ..... 472/116, 117, 472/128, 129, 88; 4/494, 496, 506

[56] References Cited

U.S. PATENT DOCUMENTS 5,154,671 10/1992 Smollar et al. ..... 472/117

*Primary Examiner*—Kien T. Nguyen

*Attorney, Agent, or Firm*—Laff, Whitesel, Conte & Saret, Ltd.

[57] ABSTRACT

A backyard toy includes an elongated slide sheet terminating in a pool. Inflatable side walls on the pool form a serpentine pathway through the pool so that a child sliding on the slide follows a zig zag path through said pool. A sprayer is provided to wet the slide and make the surface slick.

6 Claims, 5 Drawing Sheets

TOY WATER SLIDE

This application is a continuation, of prior application Ser. No. 08/250,565 filed May 27, 1994 now U.S. Pat. No. 5,551,922.

BACKGROUND OF THE INVENTION

This invention relates to toy water slides and more particularly to back yard game types of devices especially for children. Exemplary of the inventive toy water slide is the "Zig Zag Zoom" water slide sold by Marchon of Vernon Hills, Ill., 60061, U.S.A.

For background information relating to this kind of toy, reference may be made to the following U.S. Pat. Nos.: 1,648,196; 2,423,890; 2,616,096; 3,497,877; 3,665,523; 3,668,715; 4,621,383; 4,762,316 (Re 34,042); and to British Patent 2,110,444.

The toy water slide comprises an elongated strip of sheet plastic which is staked down on a lawn. A water sprinkler is also set in the lawn at a location which sprays water on the strip of plastic in order to give it a slick surface. A child runs toward the strip of plastic and belly flops on it. The inertia resulting from the run causes the child to slide over the slide surface.

In order to add interest to the play, a number of features have been added to prior art slides. For example, a hoop has been mounted over the slide with hanging curtain strips for the child to slide through. Another feature has been to provide a shallow pool of water into which the child could splash at the end of the slide. Still other slides had pillow-like bumps to raise the sliding body.

Other water slides are permanent amusement or water park type of installations featuring a long slide extending down a hill or otherwise elevated, maybe on the order of 25–30 feet high. The slide generally follows a twisting and turning path so that a person sliding down the slide has a thrilling ride. The child using the backyard slide has very likely seen the amusement or water park slide and would want a backyard toy which simulates the amusement park ride.

When a toy involves children in such an active sport, safety is always a consideration. Therefore, the toy should be inherently safe. For example, providing a twisting and turning path to simulate a water park type of ride must be accomplished by a safe structure which would not injure the child as he/she bounces off a slide-like wall. Also, stakes, which anchor the slide, should not create a hazard as the earth becomes wet and loses its stake-holding capability.

SUMMARY OF THE INVENTION

Accordingly, an object of the invention is to provide new and improved water slide means for and methods of creative play for children. Here, an object is to provide a slide with a twisting and turning path through which a child may slide.

In keeping with an aspect of the invention, these and other objects are provided by an elongated strip of sheet plastic leading to a pool section with inflated side walls which form bumpers to create a zig-zag or serpentine path through the pool. The inflated side walls have heat welded seams which create a depressed serpentine path between them. The depression between the inflated side walls at least partially fills with water and forms a path through which the child may slide.

DESCRIPTION OF THE DRAWINGS

A preferred embodiment of the invention is seen in the attached drawings, in which.

DETAILED DESCRIPTION OF THE INVENTION

Figure 1A:
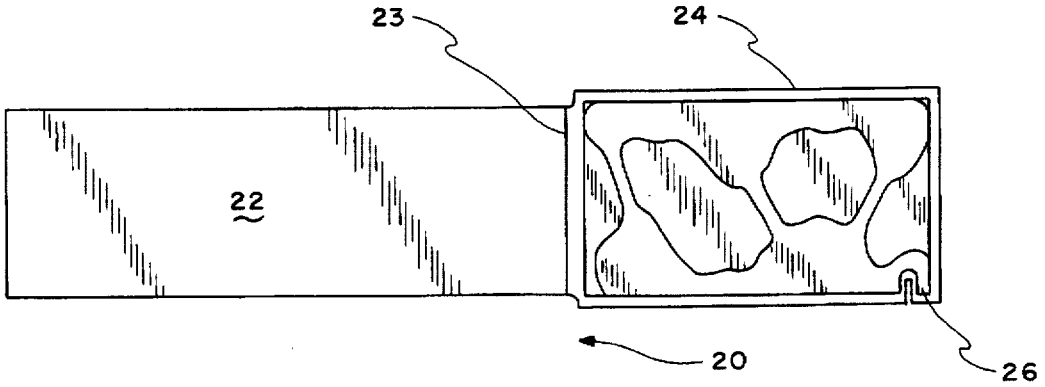
FIG. 1A is a plan view of the slide sheet and pool comprising the invention.

The toy 20 includes an elongated, rectangular slide or strip 22 of any suitable sheet plastic such as a linear, low density, virgin polyethylene with a slip additive which makes the plastic surface very slick when wet. Various blends of other elastomer materials may be mixed with the polyethylene in order to improve its strength and resistance to tearing under the kind of stresses applied to the sheet during use. Vinyl is another material which could be used.

At 23, the slide is sewn or bonded in any suitable way (e.g. heat welding) to a pool 24 which may be inflated with any suitable fluid. Water is the preferred fluid. A suitable valve 26 provides means for inflating and deflating the pool 24.

The toy also includes two staples or stakes 28 for anchoring and securing the far ends of slide 22 to the ground. The weight of the water-inflated pool 24 secures the near end of the slide, although a stake could be placed at the end of the pool if it is needed to secure pool 24.

Figure 1B:
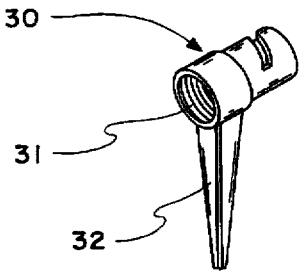
FIG. 1B is a perspective view of a stake spray head.
Figure 1C:
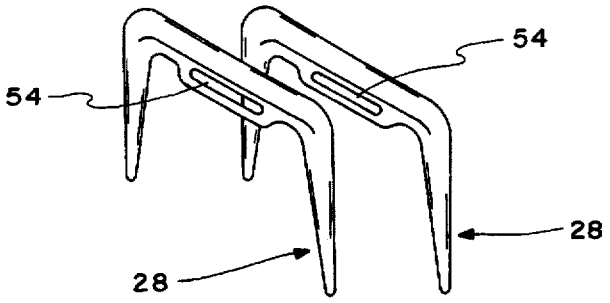
FIG. 1C is a perspective view of two stakes for attaching the slide sheet to the ground.

A spray head 30 (FIGS. 1B and 7) has a stake 32 for anchoring it in the ground near the slide. This spray head includes conventional threads at 31 so that it may be attached to a garden hose.

Figure 2:
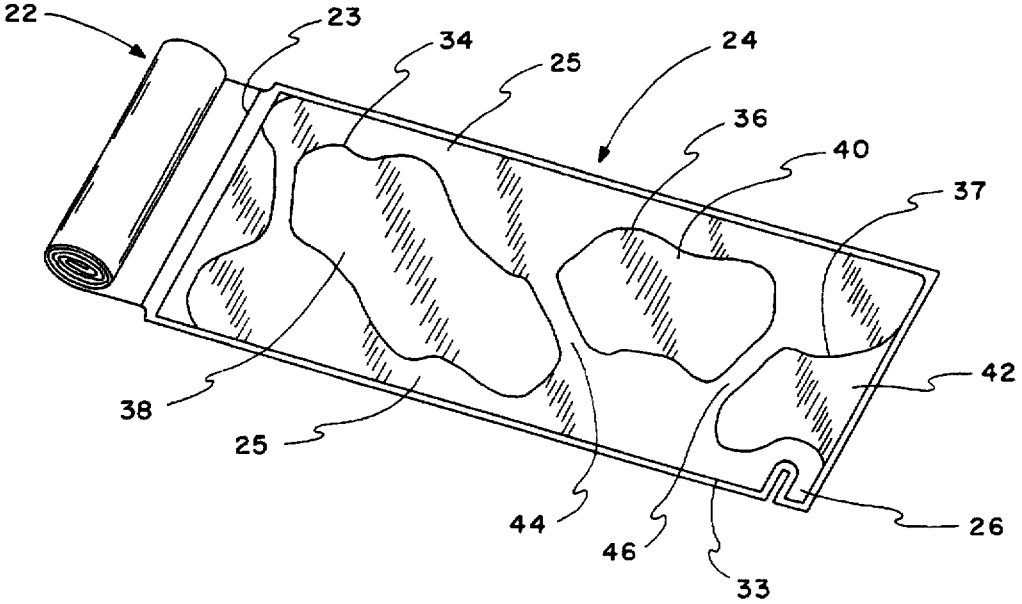
FIG. 2 illustrates laying out the water slide on the lawn.

The toy is deployed (FIG. 2) on a generally level, grassy area which is free of rocks and similar sources of potential injury and large enough for safe play. The pool 24 is laid out and the slide 22 is unrolled. The pool is made from two sheets of plastic which are heat welded or otherwise joined together at their periphery 33. Further, heat welded or other bonded seams 34, 36, 37 are formed on the two sheets to form a serpentine path 38, 40, 42. These heat welds or other bonded seams are arranged to form side walls 25 of pool 24 and to leave low-level inflatable ridges 43, 44, 46 which form basins at 38, 40, 42 to retain puddles of water. The interior of the ridges 43, 44, 46 communicates with the interior of the side walls 25. The ridges 43, 44, 46 are not high enough to interfere with the function of the inflated side walls to guide and direct a child sliding through the serpentine path 38, 40 and 42.

Of course, the heat welded seams may be modified in any suitable way in order to give the serpentine path different shapes. Regardless of its shape in plan view, there is enough of the plastic material outside the serpentine path to form relatively large side walls or bumpers 25 (e.g. 6–8 inches high) at selected locations which not only protect the sliding child, but also guide and direct his/her sliding body through the serpentine path, thereby causing the child's zig-zag motion through the slide.

The ridges 43, 44, 46 in one exemplary embodiment were no more than two inches high, at the most. An important function of the ridges is that of transferring fluid from the inflated side walls on one side of the pool to the inflated side walls on the other side of the pool. Hence, if a sliding child strikes an inflated side wall too hard, fluid will flow to the opposite side of the pool to protect the structure of the pool and to dissipate the energy of the impact. Another purpose for the ridges is to enable the pool to be filled from a single inlet. The ridges also cause shallow puddles of water to accumulate to provide a splash effect when the child slides through the pool. The ridges also help slow the child's slide without causing his/her body to rise or otherwise bounce.

Figure 3A:
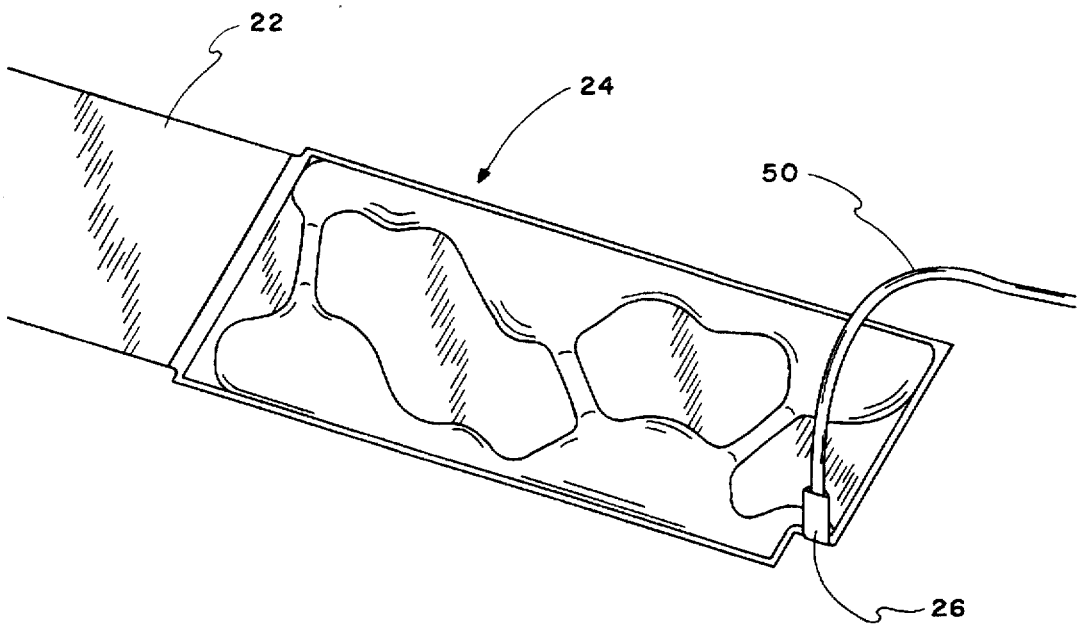
FIG. 3A illustrates filling the pool side walls in order to form bumpers prior to play.
Figure 3B:
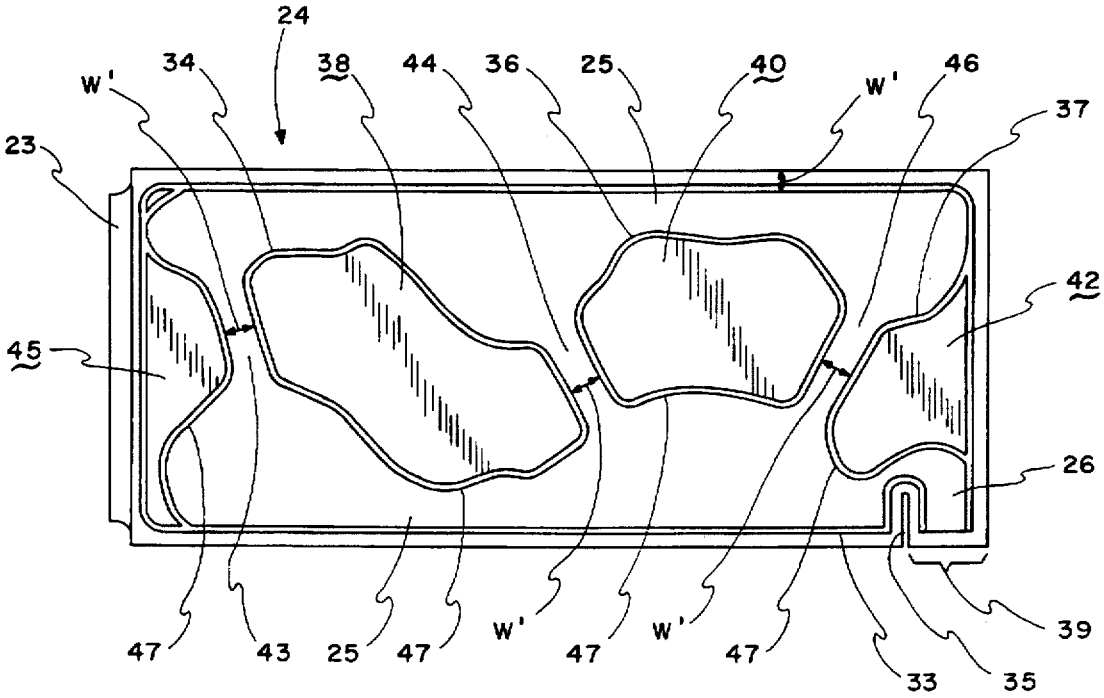
FIG. 3B is a plan view of the bonding of two sheets of plastic to form inflatable side walls which create a serpentine path through the pool.

FIG. 3B shows one possible plan view for the pool, although any suitable plan may be used. The peripheral heat sealed seam 33 completely surrounds the pool so that the side walls may be inflated. An inlet of the seam 33 coupled with a cut section 35 forms a tab that is a low cost valve 26 for enabling an inflation of the pool. The valve 26 is here shown as simply being a tab with an opening 39 into which a garden hose may be inserted to inflate the pool side walls or from which water may be drained in order to deflate the pool walls.

After the pool side walls 25 are inflated, tab 26 is twisted as shown by 26B, 26A (FIG. 3C), and then the twisted tab is folded into a U-shape 26C. A rubber band 27 or other clamp holds the U-shaped twist 26C so that the water can not leak out of the pool. An advantage of this arrangement is that the rubber band 27 may be forced off the U-shaped twist 26C if the internal pressure within the pool is too great so that the water is released to relieve the pressure before the pool is damaged.

The entire interior of the pool is in fluid communication except for the islands 38, 40, 42, 45 formed by their surrounding heat sealed seams 47. The relative widths W of the inflatable side walls 25 form relatively large bumpers at points where a child's sliding body may impact the walls 25 as the child passes through the serpentine path.

The widths W' of the ridge sections 43, 44, 46 are relatively narrow so that the ridges are low relative to the height of the large bumper side walls 25. This is so that the low ridges will not interfere with the guiding and directing function of the high bumper walls 25. However, the ridges 43, 44, 46 are just high enough to form basins for holding puddles of water and for slowing the sliding child without causing the child's body to rise or otherwise bounce off the surface of the pool.

Figure 3C:
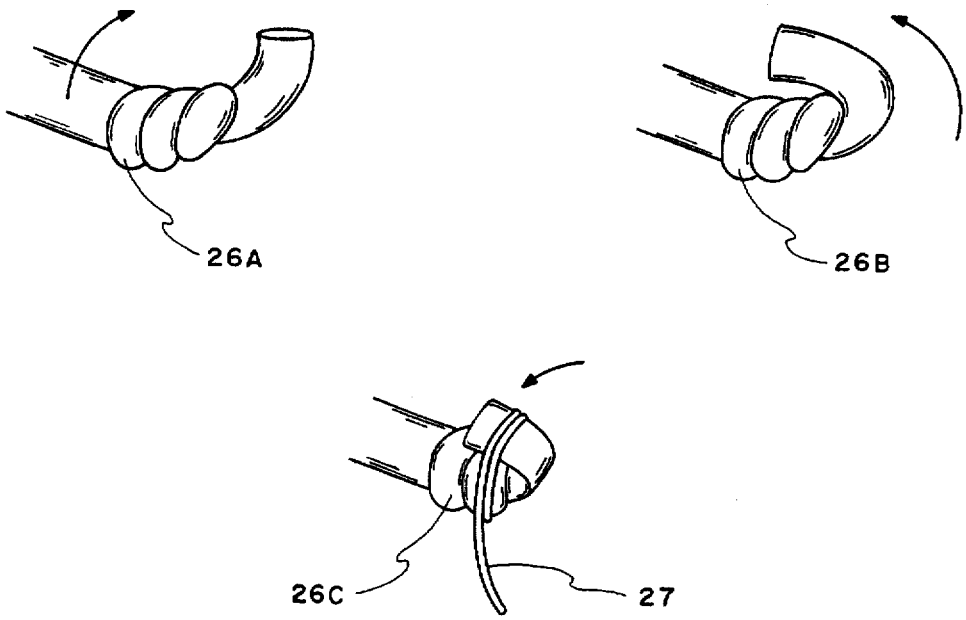
FIG. 3C shows how to close the valve for inflating the side walls after the pool walls are inflated.

FIG. 3A shows the pool 24 being inflated with water by using a garden hose 50 to direct water through valve 26. The ridges 43, 44, 46 provide fluid communicating passageways for enabling the inflation fluid such as water to flow between the pool side walls 25 and inflate them. Once the pool is full, the valve 26 is sealed in any suitable manner. For example, as shown in FIG. 3C, the valve 26 may be twisted, folded over into a U-shaped bend, and then secured in that condition, as by a rubber band 27 surrounding the bend.

Figure 4:
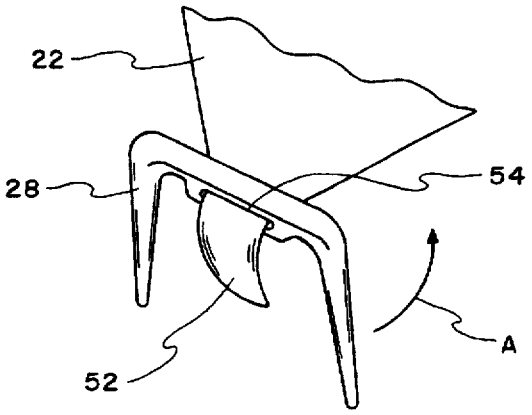
FIGS. 4 and 5 show a technique for safely attaching a stake to the slide sheet.
Figure 5:
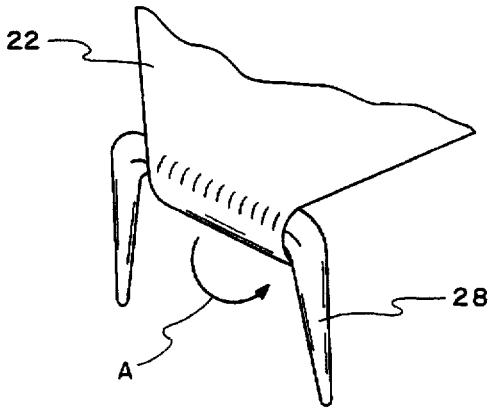

Once the weight of the water in the side walls 25 can hold one end of the slide 22 in a stable position, the opposite end is stretched. As shown in FIG. 4, corner 52 of the slide 22 is fitted through an eyelet 54 in the center of the U-shaped staple or stake 28. The staple or stake 28 is rotated in the direction A as the corner 52 of the slide is wound around the cross bar of the staple. After the slide 22 is correctly wrapped around the staple or stake 28, the stake is driven into the ground (FIG. 5).

Figure 6A:
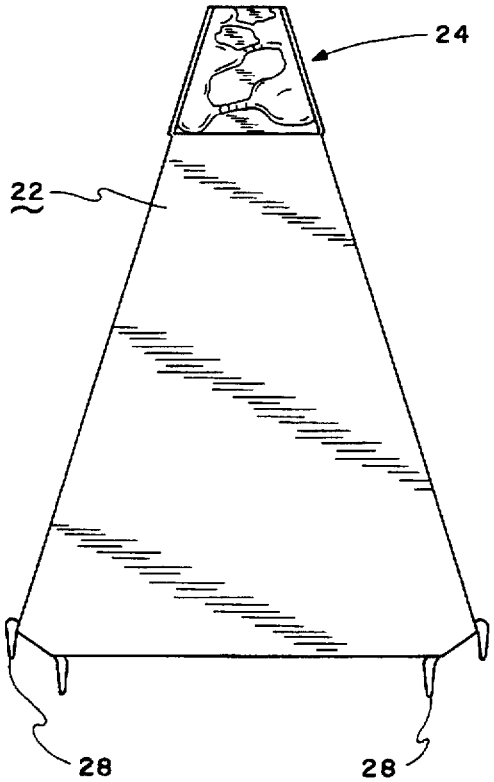
FIG. 6A shows a perspective view of the slide ready to be staked to the ground.
Figure 6B:
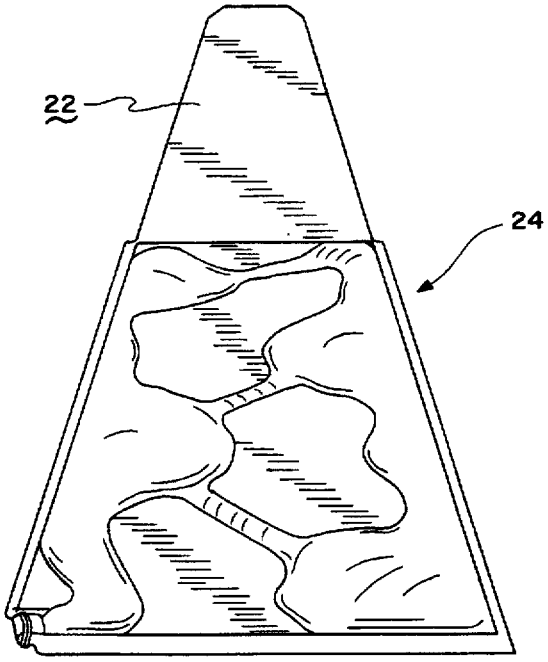
FIG. 6B shows a perspective view from the opposite end of the slide.

The stapling or staking process is repeated at the other corner on the far end of slide 22. The slide 22 (FIG. 6A) is now stretched and held tautly by the weight of the water in pool 24 and by the two stakes 28, 28. The pool is full of water so that it acts as a safety bumper on one end of the slide. All corners and edges of the staples or stakes 28 are well rounded and are generally covered by the slide material 22. FIG. 6B illustrates the toy from the pool end.

Figure 7:
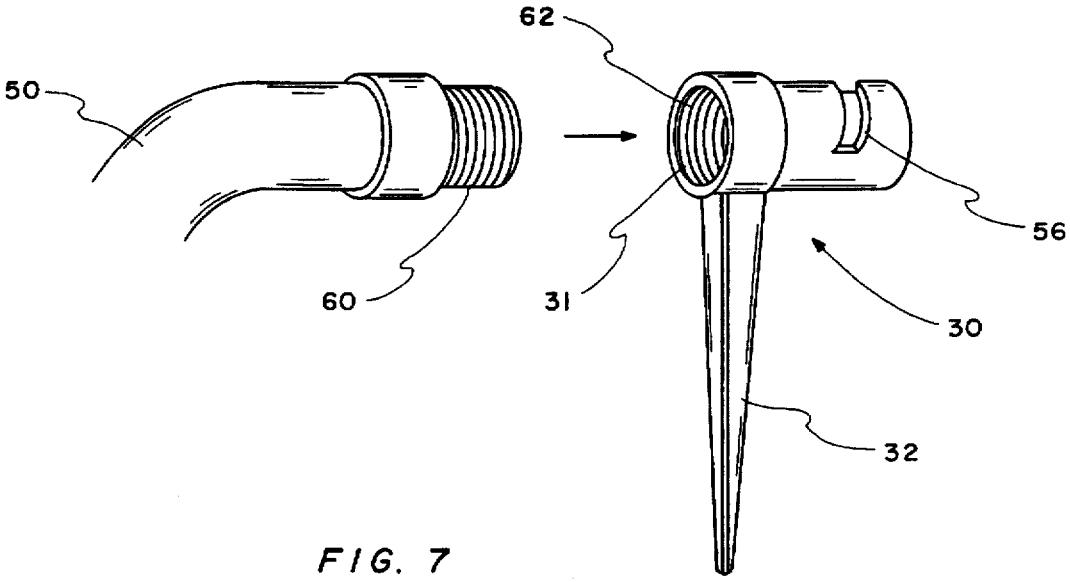
FIG. 7 is a perspective view of a garden hose and a stake spray head.
Figure 8:
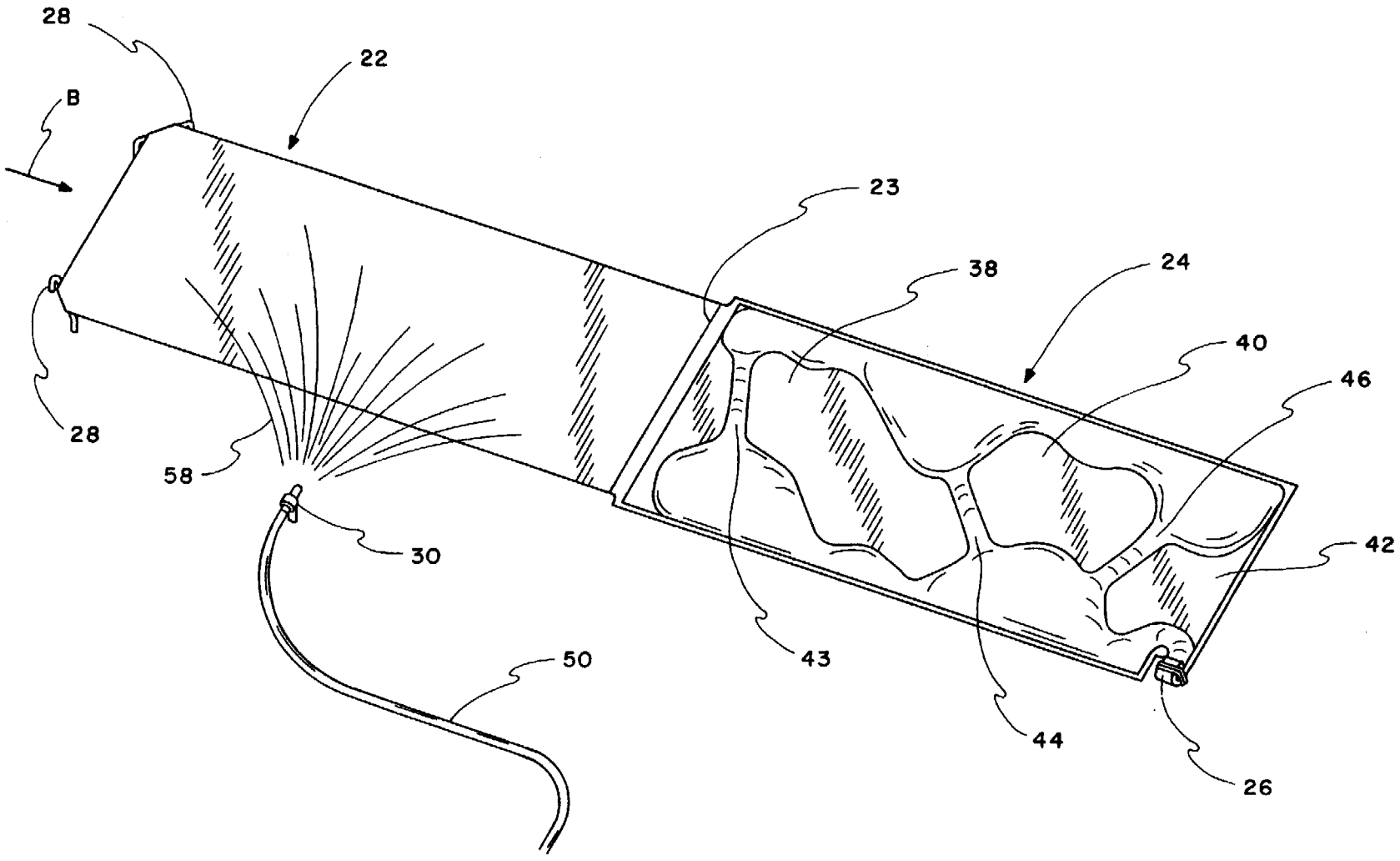
FIG. 8,is a perspective view which shows the slide staked down on a lawn with a stake spray head wetting the strip of plastic.

FIG. 7 shows the spray head 30 which has a suitable arcuate opening 56 which creates a fan-shaped spray of water 58 (FIG. 8). The cavity at the end 62 includes threads 31 which may be connected to a conventional end fitting 60 on a garden hose 50. After the spray head 30 is attached to the end fitting 60, stake 32 is pressed into the ground at a location where the spray 58 of water will wet and lubricate the slide 22.

In play, the child runs in direction B (FIG. 8) and belly flops onto the wet slide 22. His/her inertia causes him/her to slide toward pool 24. At the pool, the serpentine path 38, 40, 42 causes the sliding child to experience at least two changes of course which provides a thrilling ride. The inertia-caused energy of the sliding child is absorbed by the inflated side walls. Also, the changing directions of the serpentine path, collisions with the water inflated pool walls and ridges 43, 44, 46, and the general friction of the sliding child against the pool surface causes the child to slow down. Therefore, by the time that the child reaches the end of the serpentine path, he/she has or almost has lost their forward momentum. Hence, the toy is a very safe one.

Those who are skilled in the art will readily perceive how to modify the invention. Therefore, the appended claims are to be construed to cover all equivalent structures which fall within the true scope and spirit of the invention.

The claimed invention is:

1. A toy water slide comprising:

a pool;

an elongated slide attached to and extending outwardly from the pool, the slide having an edge adjacent to the pool;

means for tautly holding the slide on a flat and horizontal surface;

means for wetting the surface of the slide to decrease its surface friction; and the pool having portions defining a serpentine path extending from the edge of the elongated slide adjacent to the pool and winding through the pool, so that a person will move in a zig-zagging motion through the pool.

2. The toy of claim 1, wherein path includes means for forming basins on the surface of the pool to retain puddles of water.

3. The toy of claim 2 wherein the means for forming basins comprise inflated ridges.

4. The toy of claim 1 wherein the portions defining a serpentine path comprise fluid-inflated side walls.

5. The toy of claim 1 wherein the pool is made of two plastic sheets in face to face contact which are bonded along their edges.

6. The toy of claim 5 wherein the portions defining a serpentine path comprise fluid-inflated side walls formed by the bonding of the two plastic sheets along their edges.

* * * * *